US006589152B2

(12) United States Patent
Akatsu et al.

(10) Patent No.: US 6,589,152 B2
(45) Date of Patent: Jul. 8, 2003

(54) CENTRIFUGAL SEPARATOR WITH ROTOR DATA LIST INDICATION

(75) Inventors: Katsunori Akatsu, Hitachi (JP); Yoshitaka Niinai, Hitachinaka (JP); Hisanobu Oyama, Hitachinaka (JP); Takayuki Watahiki, Ibaraki-ken (JP)

(73) Assignee: Hitachi Koki Co., Ltd., Tokyo (JP)

( * ) Notice: Subject to any disclaimer, the term of this patent is extended or adjusted under 35 U.S.C. 154(b) by 63 days.

(21) Appl. No.: 09/826,916

(22) Filed: Apr. 6, 2001

(65) Prior Publication Data

US 2002/0147095 A1 Oct. 10, 2002

(51) Int. Cl.[7] ..... B04B 13/00
(52) U.S. Cl. ..... 494/10
(58) Field of Search ..... 494/1, 7–12, 16, 494/20; 210/85; 422/72

(56) References Cited

U.S. PATENT DOCUMENTS 3,480,207 A * 11/1969 Strohmaier
5,287,265 A * 2/1994 Hall et al.
5,871,435 A * 2/1999 Numata et al.

FOREIGN PATENT DOCUMENTS

| | | | |
|---|---|---|---|
| EP | 431645 | * | 6/1991 |
| GB | 2170626 | * | 8/1986 |
| GB | 2240496 | * | 8/1991 |
| JP | 2000-246148 | * | 9/2000 |
| JP | 2001-104832 | * | 4/2001 |
| WO | 99/02270 | * | 1/1999 |

* cited by examiner

*Primary Examiner*—Charles E. Cooley
(74) *Attorney, Agent, or Firm*—McDermott, Will & Emery

(57) ABSTRACT

The rotor data including a model name, a maximum rotating speed, and a rotor identification number of a rotor that is purchased after installation, for example, is stored through the inputting unit in an EEPROM in addition to the rotor data that was stored in the ROM before shipping. The inputted rotor data is displayed on the display in a list image together with the rotor data of the rotor data in the ROM to provide easily selection of the rotor. The inputted rotor data may be displayed with priority to the rotor data in the ROM. The rotor data may further include check data. It may be judged that the inputted rotor data is correctly inputted. If the rotor data is incorrectly inputted, an error message is displayed and the rotary data is not stored. If the rotor data is correctly inputted, the rotary data is registered in the RAM.

7 Claims, 7 Drawing Sheets

FIG. 2A

ROTOR LIST P1

| MODEL NAME | No | MODEL NAME | No |
|---|---|---|---|
| R26A | 15 | R19A | 2 |
| R24A | 23 | R17A | 34 |
| R22A | 27 | | |
| R21A | 26 | | |
| R20A | 1 | | |
| R20A2 | 46 | | |

▼▲ FOR TURNING THE PAGE

INPUT NO.

FIG. 2B

ROTOR LIST P2

| MODEL NAME | No | MODEL NAME | No |
|---|---|---|---|
| R12A | 31 | R10A2 | 3 |
| R12A2 | 25 | R10A3 | 45 |
| R12A3 | 41 | | |
| R12A4 | 48 | | |
| R12A5 | 16 | | |
| R10A | 30 | | |

21 22

▼▲ FOR TURNING THE PAGE

INPUT NO.

FIG. 2C

ROTOR LIST P3

| MODEL NAME | No | MODEL NAME | No |
|---|---|---|---|
| R10S | 36 | | |
| R10S2 | 4 | | |
| R7S | 37 | | |
| R4S | 39 | | |

23

▼▲ FOR TURNING THE PAGE

INPUT NO.

FIG. 8

| | INPUT VALUE (DICIMAL) | HEXADECIMAL | |
|---|---|---|---|
| ROTOR ID DATA | 33 | 21 | |
| MAX ROTATION SP ($min^{-1}$) | 20000 | 4E 20 | ONE BYTE SUM |
| ROTOR ROTATION RADIUS (mm) | 140 | 8C | |
| CHECK DATA | 27 | 1B | |

CENTRIFUGAL SEPARATOR WITH ROTOR DATA LIST INDICATION

BACKGROUND OF THE INVENTION

1. Field of the Invention

This invention relates to a centrifugal separator with rotor model name displaying.

2. Description of the Prior Art

A centrifugal separator having a display such as an LCD (liquid crystal display) is known. The LCD is provided for displaying a radius of the rotor, centrifugal acceleration (×g) of the rotating rotor, and centrifugal effect (g×sec). Moreover, the LCD displays a list of usable rotors with data from a ROM (read-only memory). In this case, data of the usable rotors are arranged in accordance with the types or model name and the maximum rotating speeds of the rotors. The data is displayed in response to a user operation for requesting the list using the data stored before shipping.

The user selects one of the usable rotors from the list on the display to use an operation function for obtaining the rotating speed and an interval which is necessary for separating the sample, or to perform variable functions.

This prior art centrifugal separator can display the model names of rotors in the market that are previously stored in the ROM, in a list image. However, this prior art centrifugal separator cannot display a model name of a new model rotor in the list image. This is because though the rotor number, the maximum rotation speed, a rotation radius are stored while the data regarding the new model rotor is stored in the RAM, the model name of the new model rotor is not stored. Thus, if the user commands displaying a list including model names of rotors, generally, only model names stored in the ROM are displayed. Further, another prior art centrifugal separator is known. This centrifugal separator displays data of rotors stored in the ROM and the RAM by dealing the rotor number of the new model rotor stored in the RAM in the same manner as the model names stored in the RAM. That is, the model number of the new model rotor is displayed as the model name. This structure provides selection of the new model rotor with the rotor number in the list. However, the rotor number is not model name, the user cannot know the model name from the list. For example, it is assumed that one user registers the rotor as "rotor 1", though this user knows the model name of the rotor 1, other users cannot know the model name of the rotor 1 from the list image. Moreover, the rotor number of the new model rotor is displayed in the list image after the model names of the rotors in the market stored in the ROM. Thus, the user must operate keys for displaying and indicating the rotor number to select the new model rotor.

Still another centrifugal separator having a rotor identifying sensor for identifying the rotor and a ROM storing data of rotors is known. Identifying is effected by using the rotor identifying sensor or inputting the identifying data. The data corresponding the identified rotor is read from the ROM to check the inputted rotating speed to provide a correct centrifugal separation condition. Moreover, initial data for a new model of a rotor may be inputted to a centrifugal separator by the user to use the new rotor.

SUMMARY OF THE INVENTION

The aim of the present invention is to provide a superior centrifugal separator.

According to the present invention, a first aspect of the present invention provides a centrifugal separator comprising: a motor for rotating one of first and second changeable rotors; input means for inputting first data of said first changeable rotors, said first data of said first changeable rotors including model names, respectively; display means; first memory means, which is writable and readable, for storing said first data; and second memory means, which is read-only type, for previously storing second data of said second changeable rotors, said second data including model names, respectively, wherein said display means displays said model names of said first and second changeable rotors from said first memory means and said second memory means in a list image.

According to the present invention, a second aspect of the present invention provides a centrifugal separator based on the first aspect, wherein each of said first and second data further includes the maximum rotating speed corresponding to said each of said changeable rotors, a rotation radius corresponding to said each of said changeable rotor, and a rotor identification number corresponding to each of said changeable rotors.

According to the present invention, a third aspect of the present invention provides a centrifugal separator based on the first aspect, wherein said first memory means comprises an EEPROM (electrically erasable programmable read-only memory).

According to the present invention, a fourth aspect of the present invention provides a centrifugal separator based on the first aspect, wherein said display means displays said model names of said first changeable rotors with priority to said model names of said second changeable rotors.

According to the present invention, a fifth aspect of the present invention provides a centrifugal separator based on the first aspect, wherein said display means displays said model names of said first changeable rotors and said model names of said second changeable rotors at different areas on said list image, respectively.

According to the present invention, a sixth aspect of the present invention provides a centrifugal separator based on the first aspect further comprising arranging means for classifying each of said first and second data into classes in accordance with each of said model names and arranging said first and second data in each class in order of the maximum rotating speed, wherein said display means displays said model names of said first and second changeable rotors every class in order of the maximum rotating speed in a list image.

According to the present invention, a seventh aspect of the present invention provides a centrifugal separator comprising: a motor for rotating one of first and second changeable rotors; input means for inputting first data of said first changeable rotors; display means; first memory means, which is writable and readable, for storing said first data; and second memory means, which is read-only type, for storing second data of said second changeable rotors in advance, wherein said display means displays said first data from said first memory means with priority to said second data from said second memory means.

BRIEF DESCRIPTION OF THE DRAWINGS

The object and features of the present invention will become more readily apparent from the following detailed description taken in conjunction with the accompanying drawings in which:

FIGS. 2A to 2C are illustrations of display images according to the first embodiment;

FIG. 8 is a table showing input values of a rotor according to the second embodiment.

The same or corresponding elements or parts are designated with like references throughout the drawings.

DETAILED DESCRIPTION OF THE INVENTION

[First Embodiment]

Figure 1:
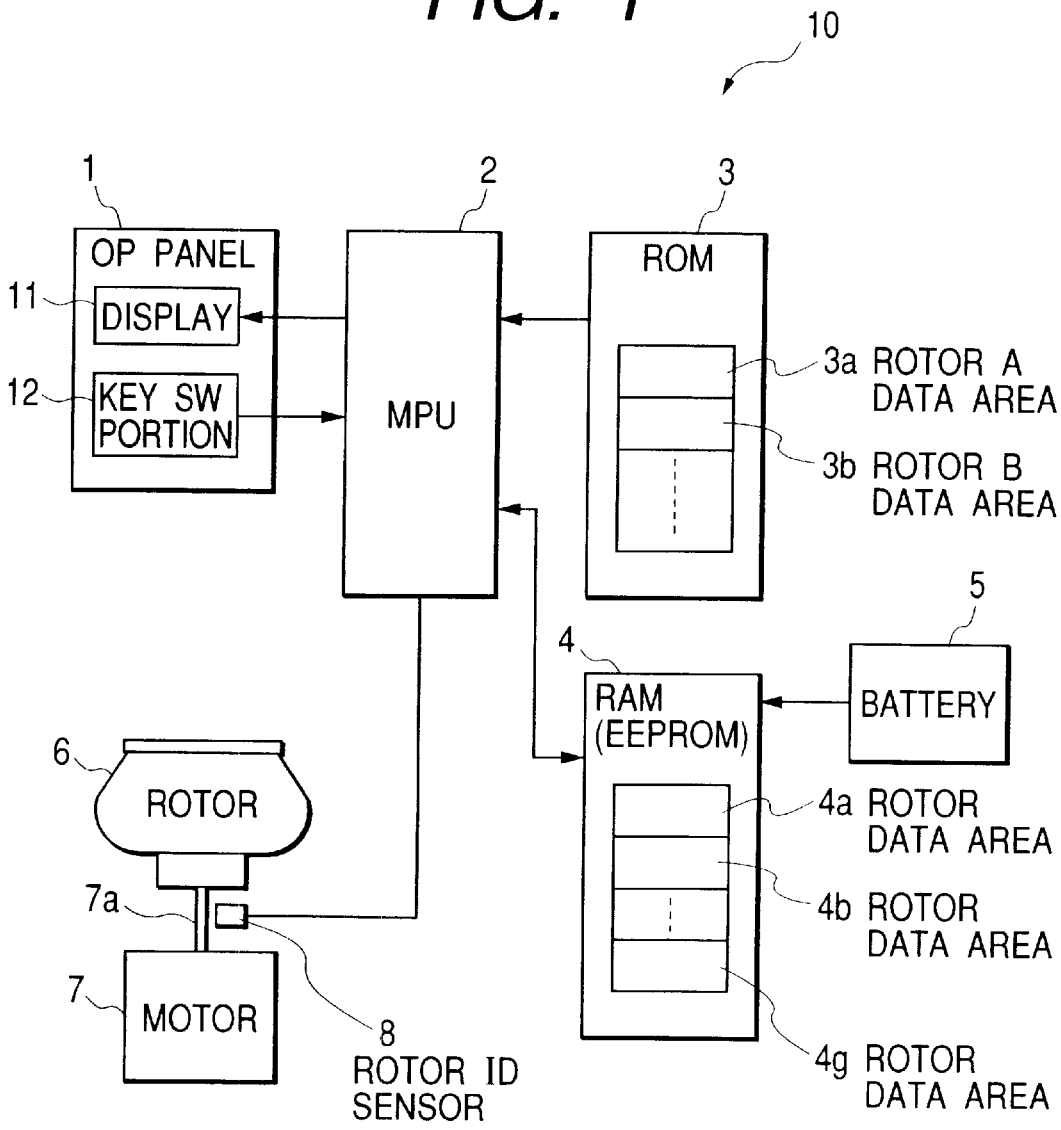
FIG. 1 is a block diagram of a centrifugal separator according to a first embodiment.

FIG. 1 is a block diagram of a centrifugal separator according to a first embodiment.

The centrifugal separator of the first embodiment includes a (changeable) rotor 6 for containing a sample, a motor 7 for rotating the rotor 6, a shaft 7*a* for coupling the rotor 6 to the motor 7, a rotor identifying sensor 8, and a control unit 10.

The control unit 10 includes an operation panel 1, a microprocessor 2, a ROM (read-only memory) 3, a RAM (random-access memory) 4, and a battery 5.

A user sets a desirable rotor to the centrifugal separator and inputs operational condition data for the desirable rotor 6 and the sample. Next, the user starts rotating the rotor 6.

The user can input the operational condition data with the operation panel 1 to store the operational condition data in the RAM 4. The data is displayed on the display 11. The RAM 4 comprises an electrically erasable and programmable read-only memory (EEPROM). Thus, the operational condition data is maintained during power off. In addition, the battery 5 maintains the data in the RAM 4 during sudden power fail or the like.

Data of a plurality of changeable rotors 6 that are on the market at shipping or at designing is stored (pre-stored) in the ROM 3 in advance (before shipping) at a rotor A data storing area 3*a,* a rotor B data storing area 3*b,* etc.

In operation, the microprocessor 2 reads the data (rotor data) stored in the ROM 3 and RAM 4 and compares the rotor identifying signal from the rotor identifying sensor 8. The rotor identifying sensor 8 detects the mark on the rotor to generate the rotor identifying signal including identification data of the rotor 6. When one of the data stored in the ROM 3 and RAM 4 agrees with or corresponds to identification data in the rotor identifying signal, the microprocessor 2 displays the model name of the rotor 6, checks whether the rotating speed inputted from the operation panel 1 exceeds the maximum rotating speed of the rotor 6 which is read from the ROM 3 or the RAM 4, and executes a weight operation of the sample.

If a rotor 6 having no mark (generally, an old model rotor) is used, or if the rotor identifying sensor 8 is in trouble, or if calculation for a rotor 6 is effected while the rotor 6 is not set to the centrifugal separator, for example, samples in the rotor 6 is cooled in a refrigerator, the rotor identifying signal is not supplied to the microprocessor 3. Thus, the microprocessor 2 can receive input of the identifying number of the desired rotor 6 by the user with the key switch portion 12 on the operation panel 1 to read the data of the desired rotor 6 every setting. However, this is inconvenient for the user.

Then, the centrifugal separator according to the first embodiment provides a list displaying function which is convenient for selecting model name of the new model rotor. Therefore, the user can display a list including the user-registered data of the rotors 6 in addition to the pre-stored data of the rotors 6 in response to a list key on the key switch portion 12. The user can select one of the desired rotors from the rotors on the list on the display 11 by inputting the corresponding number.

In response to the list key, the microprocessor 2 reads pre-stored data of the rotors 6 from the ROM 3 and user-registered data of the rotors 6 from the RAM 4 and generates a list image of the pre-stored rotor data and the user-registered rotor data of the rotors 6 to display the list image on the display 11.

The user can register the rotor data including a model name of a new rotor 6 which has been purchased after the centrifugal separator was installed. That is, the user can register the rotor data of the rotor 6, which is not stored in the ROM 3 but in the RAM 4 with the key switch portion 12.

The microprocessor 2 stores the rotor data of the new model of the rotor 6 at either of rotor data storing areas 4*a* to 4*g*. The inputted rotor data includes the model name of the centrifugal separator, the maximum rotating speed, a rotation radius, a rotor type, and a rotor identification number, or the like.

As mentioned above, the user can register the rotor data of the new model of the rotor 6 and the user can use the rotor data of the new model of rotor 6, so that the new model of the rotor 6 can be used. Moreover, if the user operates the centrifugal separator while the rotor 6 is not set in the centrifugal separator or not identified, the user can easily use the registered rotor data of the new model of rotor 6 because the registered rotor data in the RAM 4 is displayed in a list image together with the rotor data stored in the ROM 3.

Displaying operation when the rotor is not identified by the rotor identification sensor 8 will be described.

It is assumed that model names of the rotors 6 to be registered are R10A3, R10S2, and R12A5.

The user successively inputs the model name of the centrifugal separator, the maximum rotating speed, a rotation radius, an identification number or the like in response to guidance on the display 11 for each rotor. The microprocessor 2 stores the input data of rotors at the rotor data storing areas 4*a* to 4*c,* respectively.

In displaying the list, rotor display data arrangement is determined in accordance with a rule.

Figure 5:
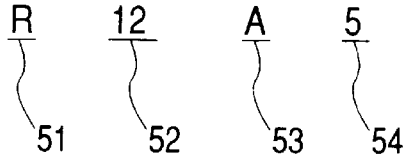
FIG. 5 is an illustration of data arrangement for a rotor according to the first embodiment.

FIG. 5 is an illustration of data arrangement of the rotor data according to the first embodiment.

The first data 51 represent the model of the centrifugal separator for which the rotor 6 is usable. The second data 52 represents the maximum rotation speed of the rotor 6, wherein the actual maximum rotating speed is obtained by a thousand times the value of the second data 52. The third data 53 represents the type of the rotor 6. "A" represents a fixed angle rotor, "S" represents a swing type of rotor, and "V" represents a vertical type of rotor for example. The fourth data 54 represents an additional number of the rotor.

Figure 3A:
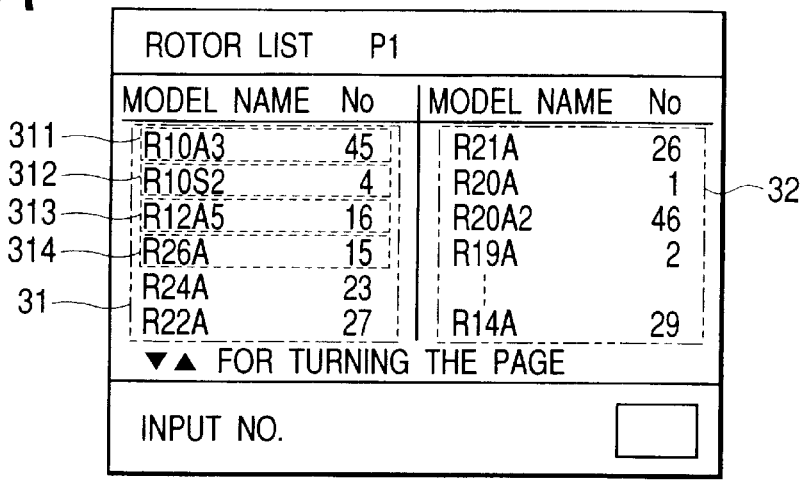
FIGS. 3A to 3C are illustrations of displaying images with priority according to the first embodiment.
Figure 3B:
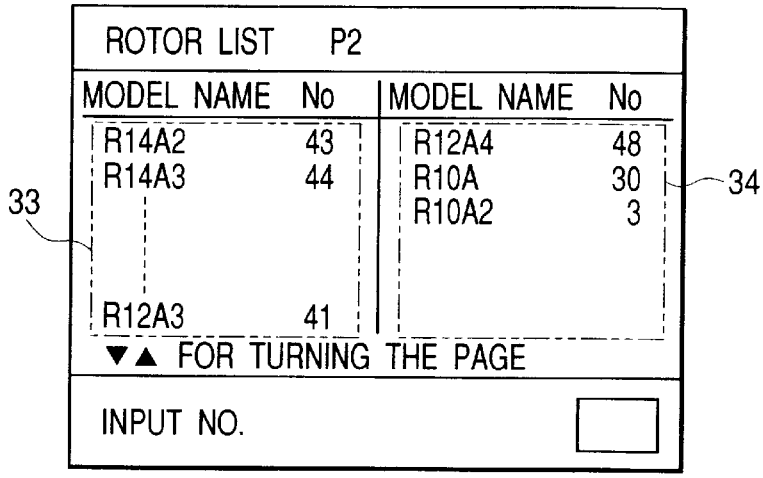
Figure 3C:
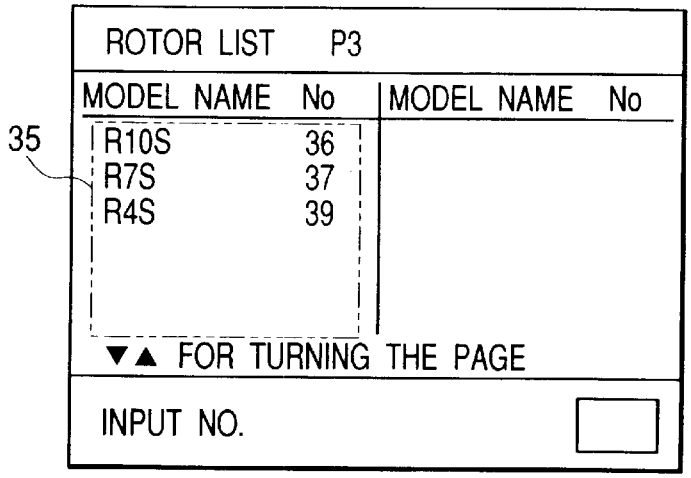

FIGS. 2A to 2C are illustrations of display images according to the first embodiment. FIGS. 3A to 3C are illustrations of displaying images with priority according to the first embodiment.

The list image is generated by the microprocessor 2 with rotor display data generated from the first to third data 51 to 52 for each rotor 6 and displayed in the list image as shown in FIGS. 2A to 2C. In the list, after each of the rotor model names, a rotor identification number is displayed. Thus, the user can input the identification number of the desired rotor corresponding to one of the identification number in the list to select the desired rotor 6.

In the list image, the rotors 6 registered by the user are displayed together with the rotors 6 which were stored before shipping.

If there are various types of rotors 6, the list may be displayed over a plurality of pages. Operating page switches on the key switch portion 12 turns the page of the list. FIG. 2A shows the first page of the list, FIG. 2B shows the second page of the list, and FIG. 3A shows the third page of the list. The rotor display data generated from the user-registered rotor data of the new models of rotors (R10A3, R10S2, and R12A5) are added in the list at the second and third pages in the predetermined order.

The data in the list is further arranged as follows:

The microprocessor 2 classifies the rotor data of the rotors 6 in the ROM 3 and the RAM 4 in accordance with the third data representing the type of the rotor stored in the ROM 3 and RAM 4. Next, the microprocessor 2 arranges rotor data in each class in accordance with the second data 52 representing the maximum rotation speed, i.e., in order of maximum rotation speed. If there are more than one rotors 6 having the same maximum speed, the rotor data including the same maximum speed are arranged in accordance with the fourth data 54 representing the additional numbers of the rotors.

As mentioned, the rotor display data arranged by the microprocessor 2 are displayed on the display. Thus, the rotor model name (R10A3) in the data stored at the rotor data area 4*a* is displayed at the rotor display portion 22. The rotor model name (R10S2) in the data stored at the rotor data area 4*b* is displayed at the rotor display portion 23. The rotor model name (R12A5) in the data stored at the rotor data area 4*g* is displayed at the rotor display portion 21.

As mentioned above, the rotor display data generated from the user-registered data of the new models of rotors can be displayed in the list. Here, it is general that the new model of rotors 6 purchased by the user after installation of the centrifugal separator are more frequently used than the rotors purchased at the installation of the centrifugal separator. Then, the rotor display data of the new model rotors purchased after the installation are displayed prior to the rotor display data of the rotors purchased at the installation as shown in FIGS. 3A to 3C.

The microprocessor 2 reads the data stored in the rotor data area 4*a* in the RAM 4. If the rotor data is stored there, the microprocessor 2 displays the rotor display data (rotor model name R10A3 and No. 45) at the rotor display area 311. The microprocessor 2 reads the data stored in the rotor data area 4*b* in the RAM 4. If the rotor data is stored there, the microprocessor 2 displays the rotor display data (rotor model name R10S2 and No. 4) at the rotor display area 312. The microprocessor 2 reads the rotor data stored in the rotor data area 4*g* in the RAM 4. If the rotor data is stored there, the microprocessor 2 displays the rotor display data (rotor model name R12A5 and No. 1) at the rotor display area 313.

Moreover, if there is no data at one of rotor data areas 4*a* to 4*g*, the microprocessor 2 closely displays the former data and following data of the rotors.

Next, the microprocessor 2 classifies the rotor data in the ROM 3 and arranges the rotor data in order of the maximum rotating speed and displays the rotor display data generated from rotor data in the ROM 3, on the display 11. In the first embodiment, the microprocessor 2 displays the rotor display data of the fixed-angle type of rotor having a high maximum rotating speed, at the rotor display area 314 at first. When the display area 31 (the left portion of the page) has been displayed, the microprocessor 2 displays the rotor data of rotors 6 at the display area 32.

When the user depresses a page switch, the rotor display data following to the display area 32 is displayed at a display area 33 at the next page. If the rotor display data of the fixed-angle type of rotors have been finished at intermediate position of the display area 34, a different type of the rotor (swing type of rotors) are displayed at the next page.

Figure 4A:
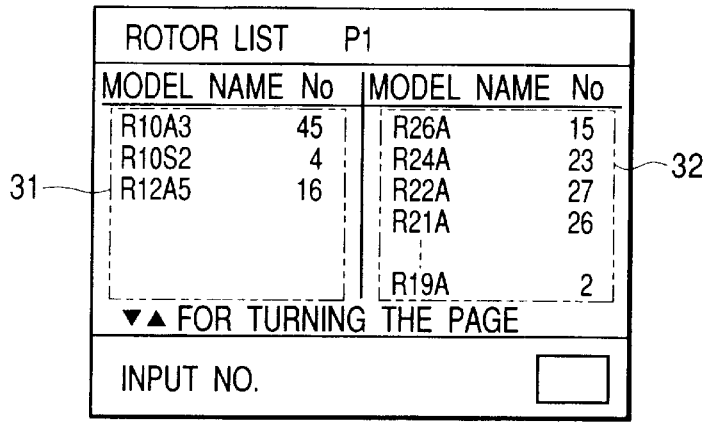
FIGS. 4A to 4C show display images in various manners.
Figure 4B:
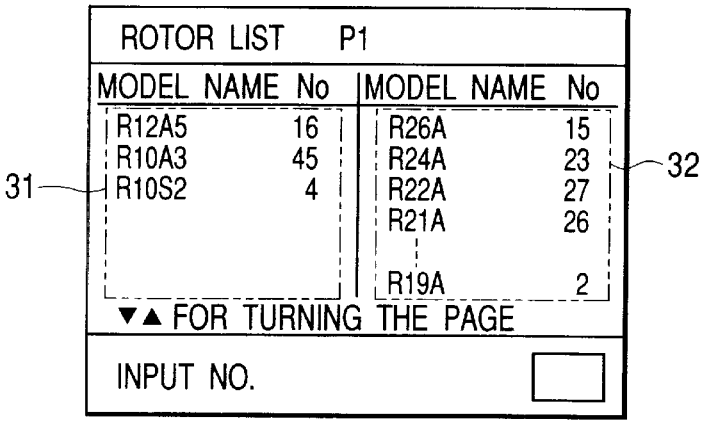
Figure 4C:
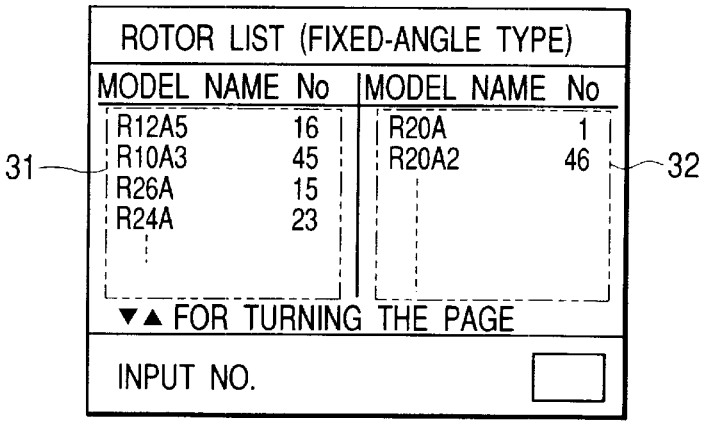

FIGS. 4A to 4C show display images in various manners.

The microprocessor 2 displays the rotor display data of the rotors 6 inputted from the operation panel 1 only at the display area 31. On the other hand, the display area 32 is used only for display the data of the rotors 6 stored in the ROM 3. Thus, the rotor display data of the rotors 6, inputted from the operation panel 1, stored in the RAM 4 are displayed independently from the data of rotors 6 previously stored in the ROM 3. That is, the rotor display data of the rotors, inputted from the operation panel 1, stored in the RAM 4 and the rotor display data of rotors previously stored in the ROM 3 are displayed at the different areas on the display 11 to provide clear display images. If no rotor display data is stored in the RAM 4, the rotor data stored in the ROM 3 are displayed at the display area 31.

As shown in FIG. 4B, the rotor data stored in the rotor data areas 4*a* to 4*g* in the RAM 4 are classified in accordance with the type of the rotors 6 and arranged in order of maximum rotation speed to provide a clear image.

As shown in FIG. 4C, the rotor data stored in the ROM 3 and RAM 4 are classified in accordance with the type of the rotors 6. The microprocessor 2 displays the rotor display data of the fixed-angle rotors, for example, at the display area 31 as follows:

The rotor data of the fixed-angle type of rotors stored at the rotor data areas 4A to 4Bg in the RAM 4 are arranged in order of maximum rotation speed and displays at the display area. Next, in the following area, the rotor display data of the fixed-angle type of rotors are displayed at the display area 31.

As mentioned above, the rotor data inputted from the operation panel 1 by the user can be displayed in a list image. Moreover, priority in displaying may be provided. The rotor display data from the RAM 4 and ROM 3 are independently displayed. Thus, it is easy to search the desired rotor from the list, so that usability is improved.

[Second Embodiment]

Figure 6:
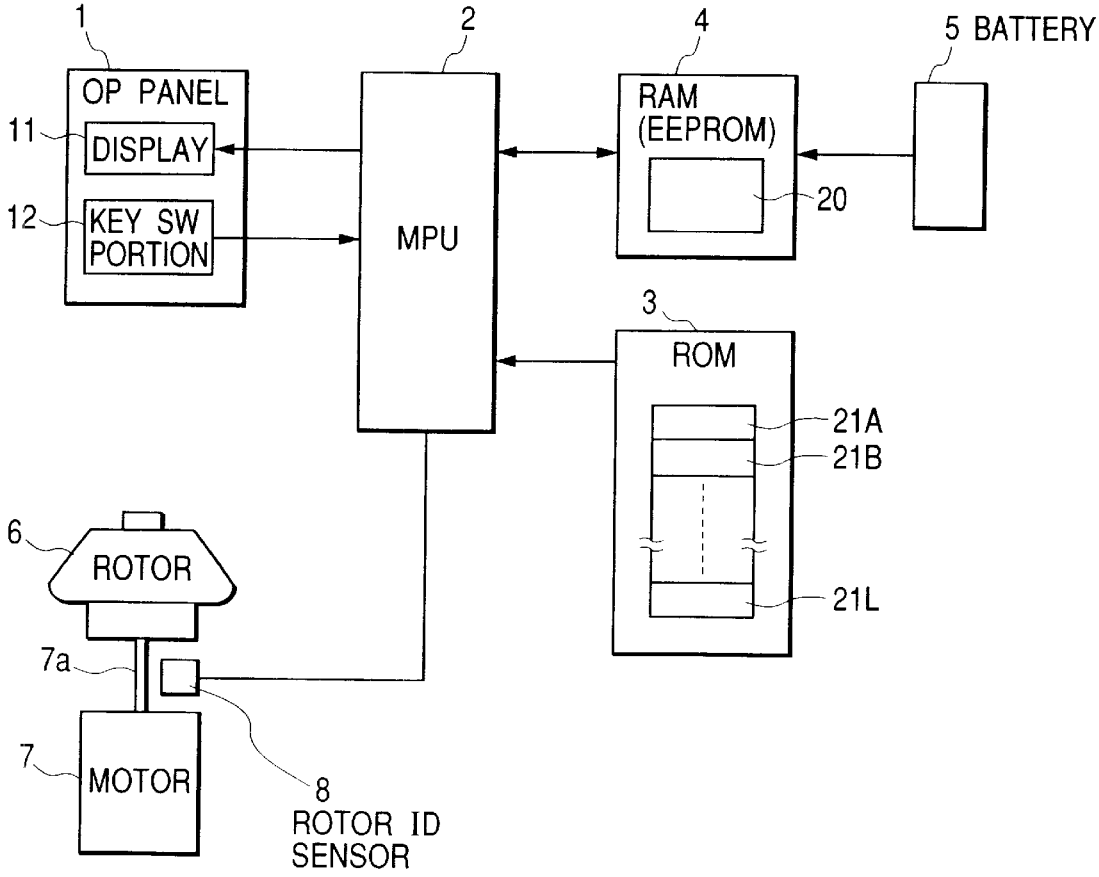
FIG. 6 is a block diagram of a centrifugal separator according to a second embodiment.

FIG. 6 is a block diagram of a centrifugal separator according to a second embodiment. The centrifugal separator according to the second embodiment has substantially the same structure as the first embodiment. The difference is that the inputted rotor data is checked.

The operational condition data inputted from the key switch portion 12 is stored in the RAM 4 and displayed on the display 11 by the microprocessor 2.

The rotor data for a plurality of rotors A to L is stored in a rotor A data area 21A, a rotor B data area 22B, - - - , and a rotor L data 21L. When the user sets a rotor in the centrifugal separator and operates the centrifugal separator, the rotor identification sensor 8 identifies the rotor. That is, the mark on the rotor is read by the rotor identification sensor 8 to generate the identification signal supplied to the microprocessor 2.

The microprocessor 2 reads the rotor data corresponding to the rotor which is now set from the corresponding data area at the ROM 3.

When a new rotor which is not registered in the ROM 3, is purchased, the user can input the rotor data with the operation panel 1 to store at a rotor data storing area 20 at the RAM (EEPROM) 4. The rotor data inputted from the operation panel 1 includes rotor identification number, a maximum rotation speed, a rotor rotation radius, and check data for checking whether the rotation data is correctly inputted.

Figure 7:
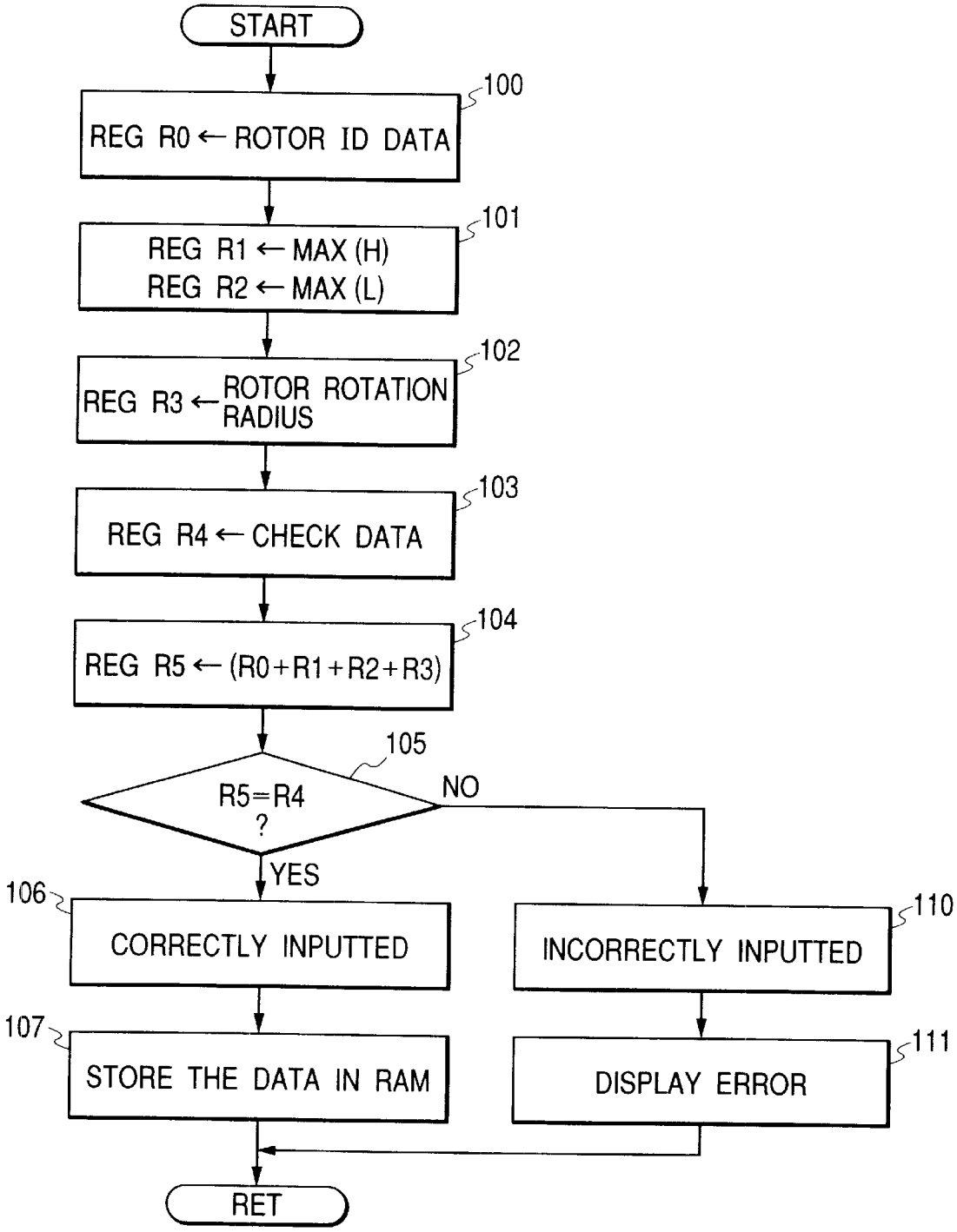
FIG. 7 depicts a flow chart of data checking in input operation according to the second embodiment.

FIG. 7 depicts a flow chart of data checking in input operation according to the second embodiment. FIG. 8 is a table showing input values of a rotor M.

The column of input value shows the rotor identification data, the maximum rotation speed, the rotor rotation radius, and the check data in decimal notation. The column of hexadecimal shows the corresponding values in hexadecimal notation.

The rotor identification data is used for comparison with the identification data in the rotor identification signal from the rotor identification sensor 8. The identification data of the rotor M is "33" in decimal notation and "21" in hexadecimal notation. The maximum rotation speed is "20000" in decimal notation if the maximum rotation speed of the rotor M is 20000 min–1 and represented with "4E20" in hexadecimal notation. The rotor rotation radius is used for obtaining the centrifugal force of the rotor M. If it is assumed that the radius of the rotor M is 140 mm, the hexadecimal value is "8C". The check data is provided for checking whether the rotor identification data, the maximum rotation speed, and the rotor rotation radius are correctly inputted.

The check data is generated by summing the rotor identification data, the maximum rotation speed, the rotor rotation radius in hexadecimal notation at a unit of one byte. In the case of the rotor M, the one-byte summing is given by:

$$21+4E+20+8C=11B \text{ (hexadecimal notion)}$$

If there is a carry, only lower one byte "1B" is used as the check data. That is, the carry is neglected.

The user inputs the check data of "27" in decimal notation corresponding to the value of "1B" in hexadecimal notation. More specifically, the user inputs the rotor data from the data sheet attached to the rotor M as mentioned above.

FIG. 7 depicts a flow chart of checking the inputted rotor data according to the second embodiment.

When the user inputs the rotor identification data, "33", the microprocessor 2 loads "21" in hexadecimal notation in a register R0 thereof in step 100. Next, when the user inputs the maximum rotation speed, "20000", the microprocessor 2 loads "4E" in hexadecimal notation in a register R1 thereof as the higher byte of the maximum rotation speed and loads "20" in hexadecimal notation in a register R2 thereof as the lower byte of the maximum rotation speed in step 101. When the user inputs the rotor rotation radius "140", the microprocessor 2 loads "8C" in hexadecimal notation in a register R3 thereof in step 102. When the user inputs the check data, "27", the microprocessor 2 loads "1B" in hexadecimal notation in a register R4 thereof. Next, the microprocessor 2 sums values in the registers R0 to R3 through one-byte-summing operation and loads the result in a register R5 in step 104. In the one-byte-summing operation, the carry is neglected, so that only "1B" in hexadecimal notation is loaded in the resister R5. The microprocessor 2 compares the value in the register R5 with that in the register R4 in step 105. If the value in the register R5 agrees with that in the register R4 in step 105, the microprocessor 2 judges that the rotor data has been correctly inputted, in step 106. Next, the microprocessor 2 stores the rotor data of the rotor M in the RAM 4 in step 107. If the value in the register R5 disagrees with that in the register R4 in step 105, the microprocessor 2 judges that the rotor data has been incorrectly inputted, in step 110. Next, the microprocessor 2 displays an error message to inform the user of incorrectly inputting the rotor data in step 111.

After steps 107 and 111, processing returns to the main routine (not shown).

For example, if the user incorrectly input the maximum rotation speed, 21000 $min^{-1}$, "52" in hexadecimal notation is loaded in the register R1 and "08" in hexadecimal notation is stored in the register R2. Then, the one-byte-summing operation becomes 21+52+08+8C=107 in hexadecimal notation. Thus, the lower one byte value of "07" in hexadecimal notation is stored in the register R5. Then, because the value in the register R4 is "1B" in hexadecimal notation, R5≠R4. Thus, the microprocessor 2 can judge that the rotor data of the rotor M has been incorrectly inputted in step 110.

As mentioned above, the rotor data includes the data regarding the rotor and the check data. When the user inputs the rotor data, the microprocessor 2 checks whether the rotor data is correctly inputted with the check data. Thus, reliable and safety operation is provided without replacement of the ROM.

What is claimed is:

1. A centrifugal separator comprising:

a motor for rotating one of first rotors and second rotors;

input means for inputting model names of said first rotors;

first memory means, who is writable and readable, for storing said model names of said first rotors; and second memory means, which is read-only type, for storing model names of said second rotors in advance, display means for displaying data and for displaying said model names of said first rotors and said second rotors from said first memory means and said second memory means in a list image.

2. A centrifugal separator as claimed in claim 1, wherein each of said model names of said first rotors and said second rotors, which are displayed by said display means, includes maximum rotating speed data corresponding to each of said first rotors and said second rotors, rotation radius data corresponding to said each of said first rotors and said second rotors, and rotor identification number data corresponding to said each of said first rotors and said second rotors.

3. A centrifugal separator as claimed in claim 1, wherein said first memory means comprises an EEPROM.

4. A centrifugal separator as claimed in claim 1, wherein said display means displays said model names of said first rotors with priority to said model names of said second rotors.

5. A centrifugal separator as claimed in claim 1, wherein said display means displays said model names of said first rotors and said model names of said second rotors at different areas on said list image, respectively.

6. A centrifugal separator as claimed in claim 1, wherein each of said model names of said first rotors and said second rotors includes type data of each of said first rotors and said second rotors, said centrifugal separator further comprising:

arranging means for classifying each of said model names of said first rotors and said second rotors into classes in accordance with each of said type data and arranging said model names of said first rotors and said second rotors in each class in order of the maximum rotating speed, wherein said display means display said model names of said first rotors and said second rotors in said each class in order of the maximum rotating speed in said list image.

7. A centrifugal separator comprising:

a motor for rotating one of first rotors and second rotors;

input means for inputting first data of said first rotors;

first memory means, which is writable and readable, for storing said first data; and second memory means, which is read-only type, for second data of said second rotors in advance, display means for displaying data and for displaying said first data of said first memory means with priority to said second data from said second memory means.

* * * * *